United States Patent [19]

Renner

[11] Patent Number: 4,745,052

[45] Date of Patent: May 17, 1988

[54] COLOR PHOTOGRAPHIC RECORDING MATERIAL CONTAINING 2-EQUIVALENT MAGENTA COUPLERS

[75] Inventor: Günter Renner, Bergisch Gladbach, Fed. Rep. of Germany

[73] Assignee: Agfa Gevaert Aktiengesellschaft, Leverkusen, Fed. Rep. of Germany

[21] Appl. No.: 63,688

[22] Filed: Jun. 19, 1987

[30] Foreign Application Priority Data

Jul. 1, 1986 [DE] Fed. Rep. of Germany ..... 3622007

[51] Int. Cl.[4] ..... G03C 1/40; G03C 7/36

[52] U.S. Cl. ..... 430/555; 430/544; 430/551

[58] Field of Search ..... 430/551, 555, 544, 957

[56] References Cited

U.S. PATENT DOCUMENTS

| | | | |
|---|---|---|---|
| 4,383,027 | 5/1983 | Ishikawa et al. | 430/551 |
| 4,491,630 | 1/1985 | Ishikawa et al. | 430/551 |
| 4,556,630 | 12/1985 | Furutachi et al. | 430/555 |

*Primary Examiner*—Richard L. Schilling
*Attorney, Agent, or Firm*—Connolly & Hutz

[57] ABSTRACT

2-equivalent magenta couplers with improved properties corresponding to the formula wherein X denotes O, S or $NR_9$, $R_1$ denotes hydrogen, halogen or alkoxy, $R_2$ denotes halogen, alkoxy, acylamino, alkoxycarbonyl, aminocarbonyl which may be substituted on the nitrogen or aminosulphonyl which may be substituted on the nitrogen, $R_3$ denotes hydrogen, halogen, alkoxy, alkyl, acylamino or alkoxycarbonyl, $R_4$ denotes hydrogen or alkyl, $R_5$ denotes a substituent having electron donor properties, $R_6$ and $R_7$ denote alkyl, acyl or sulphonyl, $R_8$ denotes a substituent having electron acceptor properties, $R_9$ denotes hydrogen or alkyl, m has a value from 1 to 5, n and o each have the value 0, 1 or 2 and p and q each have the value 0 or 1 and the sum of p and q is 1 or 2.

3 Claims, No Drawings

COLOR PHOTOGRAPHIC RECORDING MATERIAL CONTAINING 2-EQUIVALENT MAGENTA COUPLERS

This invention relates to a colour photographic recording material containing at least one silver halide emulsion layer and at least one layer containing a 2-equivalent magenta coupler having a particular constitution.

It is known to use pyrazolone compounds having a free 4-position in the pyrazolone ring as magenta couplers (4-equivalent magenta couplers) in colour photographic light-sensitive recording materials. These compounds, however, have little effect in producing the colour image and they are insufficiently stable, especially when stored under tropical conditions.

To improve the colour producing effect, so-called 2-equivalent magenta couplers have been used in which a substituent is introduced in the coupling position of the pyrazolone magenta. coupler and is subsequently split off as fugitive group in the process of colour development. Couplers of this kind have been described, for example, in U.S. Pat. Nos. 3,311,476, 3,419,391, 3,617,291 and 3,926,631. Other magenta couplers in which a substituent, in particular an aryl group is attached to the coupling position through a sulphur atom are described in U.S. Pat. Nos. 3,214,437, 4,032,346, 3,227,554 and 3,701,783 and in JA No. 34044/78 and in DE-OS No. 2 944 601.

Extensive investigations have shown that when couplers having one of the described arylthio groups as fugitive group is used, the stability of the colour images to light is not entirely satisfactory.

It has also been found that many of the thiophenols released in the coupling reaction of such 2-equivalent couplers are not photographically harmless. They are liable to prevent further development and may also inhibit the process of bleach fixing after development. The latter can be recognized by the presence of a persistent Ag° image.

Another disadvantage of the known 2-equivalent magenta couplers is their tendency to undergo fogging in storage. Amino substituted arylthio fugitive groups such as, for example,

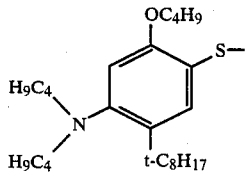

which are free from this defect have been described in U.S. Pat. No. 4,556,630 but their disadvantage lies in the very complicated procedure required for their synthesis.

It is an object of the present invention to provide 2-equivalent magenta couplers which 1. are suitable for colour photographic materials viewed by reflected light, i.e.
   (a) have suitable absorption properties,
   (b) are highly effective in producing the colour,
   (c) have great stability both in dry and in moist heat,
   (d) have great stability in the presence of formaldehyde after development, (e) do not inhibit bleaching in bleach fixing baths, in particular after prolonged use,
   (f) give rise to dyes with excellent stability both in dry and in moist heat and in the presence of light and
   (g) have a lower development fog,
2. contain readily accessible groups which are split off in the coupling reaction with oxidized colour developer and
3. are relatively unaffected by the usual change in pH of the colour developer.

It has now been found that these objects can be realized with 2-equivalent magenta couplers having the structure indicated below.

The present invention thus relates to a colour photographic recording material containing at least one silver halide emulsion layer and at least one layer containing a 2-equivalent magenta coupler corresponding to the formula

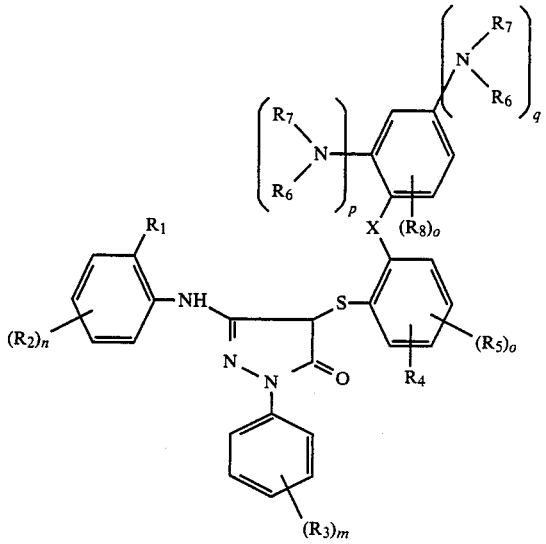

wherein

X denotes O, S or $NR_9$, $R_1$ denotes hydrogen, halogen, preferably chlorine, or alkoxy, preferably with 1 to 4 carbon atoms, $R_2$ denotes halogen, preferably chlorine, alkoxy preferably with 1 to 16 carbon atoms, acylamino, alkoxycarbonyl, aminocarbonyl which may be substituted on the nitrogen, aminosulphonyl which may be substituted on the nitrogen or alkyl, in particular with 1 to 16 carbon atoms, $R_3$ denotes hydrogen, halogen, preferably chlorine, cyano, alkoxy preferably with 1 to 4 carbon atoms, alkyl preferably with 1 to 16 carbon atoms, acylamino, alkoxycarbonyl or alkylsulphonyl preferably with 1 to 12 carbon atoms, $R_4$ denotes hydrogen or alkyl, in particular tertiary alkyl groups with 4 to 8 carbon atoms, $R_5$ denotes a substituent having electron donor properties, $R_6$ and $R_7$ denote alkyl, preferably with 1 to 4 carbon atoms, alkylcarbonyl or alkylsulphonyl, $R^8$ denotes a substituent having electron acceptor properties, $R_9$ denotes hydrogen or alkyl preferably with 1 to 4 carbon atoms, m has a value from 1 to 5 and n and o each have the value 0, 1 or 2,
p and q each have the value 0 or 1
and when m. n and/or o has a value greater than 1, the substituents $R_2$, $R_3$, $R_5$ and $R_8$ may be identical or different and the sum of p and q is 1 or 2.

The following formulae denote specific examples of suitable acylamino groups $R_2$ and $R_3$:

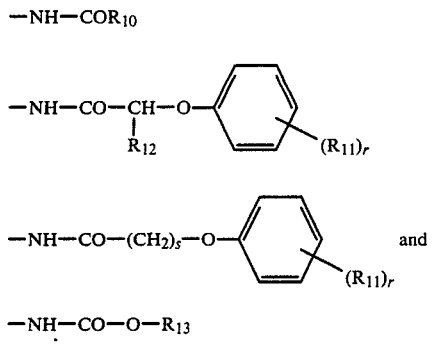

wherein
$R_{10}$ denotes a $C_9$ to $C_{15}$-alkyl group,
$R_{11}$ denotes alkyl,
$R_{12}$ denotes hydrogen or a $C_1$ to $C_8$-alkyl group,
$R_{13}$ denotes a $C_{10}$ to $C_{18}$-alkyl group,
r has a value from 1 to 3 and
s has a value from 2 to 4
and the sum of carbon atoms of all the alkyl groups $R_{11}$ attached to a molecule is 6 to 15.

Suitable alkoxycarbonyl groups $R_2$ and $R_3$ are, in particular, $C_{10}$ to $C_{18}$-alkoxycarbonyl groups.

Suitable aminocarbonyl groups and aminosulphonyl groups $R_2$ are, in particular, those corresponding to the formulae:

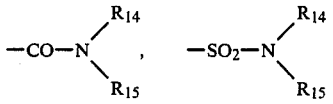

wherein $R_{14}$ and $R_{15}$ denote, independently of one another, either hydrogen or a $C_1$ to $C_{20}$-alkyl group.

Suitable electron donor groups $R_5$ may be, in particular, $C_1$ to $C_6$-alkyl groups, halogen, hydroxyl, $C_1$ to $C_6$ alkoxy or di-$C_1$ to $C_6$-alkylamino.

Suitable electron acceptors $R_8$ are, in particular, halogen, cyano, trifluoromethyl, nitro, $C_1$ to $C_8$-alkylsulphonyl and di-$C_1$ to $C_8$-alkylaminosulphonyl.

Alkylcarbonyl and alkylsulphonyl groups $R_6$ and $R_7$ have in particular 1 to 8 carbon atoms.

For preferred 2-equivalent magenta couplers,
X stands for O,
$R_1$ stands for hydrogen, chlorine or a $C_1$ to $C_4$-alkoxy group,
$R_2$ stands for chlorine, $C_8$ to $C_{20}$-alkylcarbonylamino or $C_{10}$ to $C_{18}$-alkoxycarbonyl,
$R_3$ stands for chlorine, cyano, $C_1$–$C_4$-alkoxy or $C_{10}$ to $C_{18}$-alkoxycarbonyl,
$R_4$ stands for hydrogen or tert.-$C_4$–$C_8$-alkyl,
$R_5$ stands for hydroxyl, chlorine or $C_1$ to $C_6$-alkyl,
$R_6$ and $R_7$ stand for $C_1$ to $C_4$-alkyl groups,
$R_8$ stands for chlorine, cyano or trifluoromethyl,
m has a value from 1 to 3 and
n, o, p and q represent 0 or 1, and the sum of p and q is 1 or 2.

Couplers corresponding to the following formula are particularly preferred:

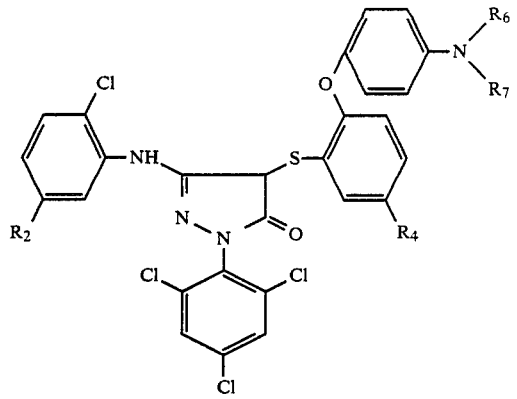

wherein
$R_2$ denotes a $C_8$- to $C_{20}$-alkylcarbonylamino group,
$R_4$ denotes a tertiary $C_4$- to $C_8$-alkyl group and
$R_6$ and $R_7$ denote $C_1$- to $C_4$-alkyl groups.

Examples of suitable residues having the partial structure

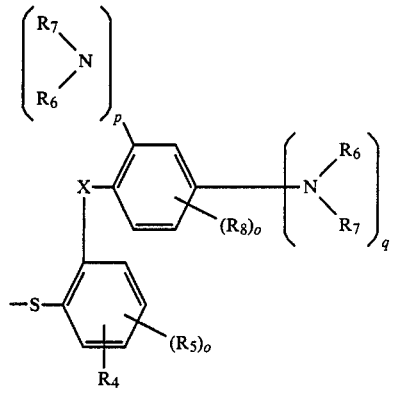

are shown below:

A1

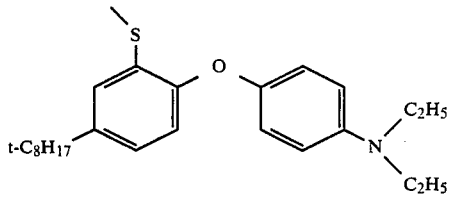

A2

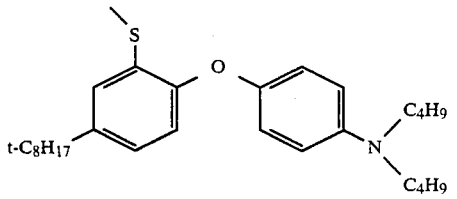

-continued
A3
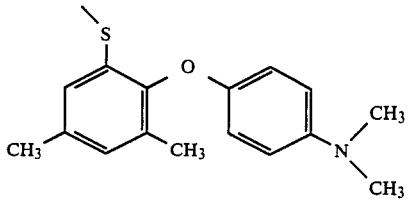
A4
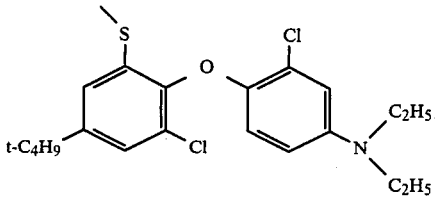
A5
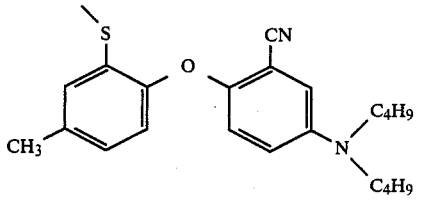
A6
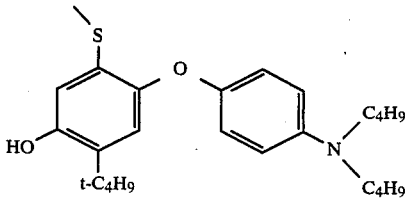
A7
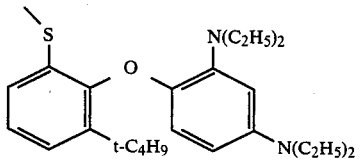
A8
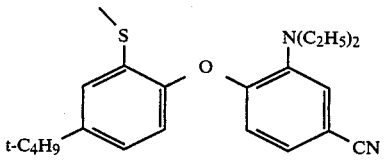
A9
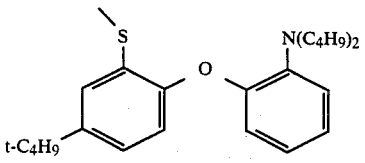
-continued
A10
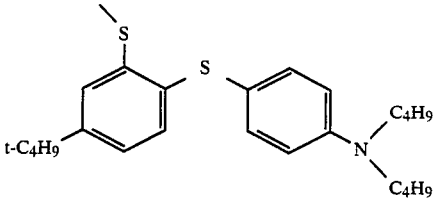
A11
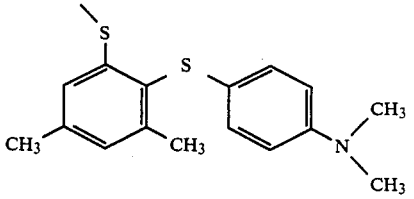
A12
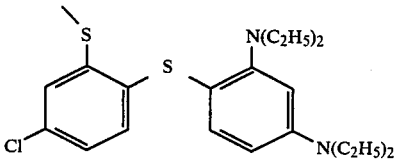
A13
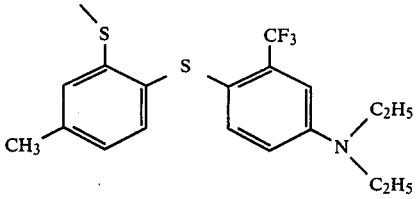
A14
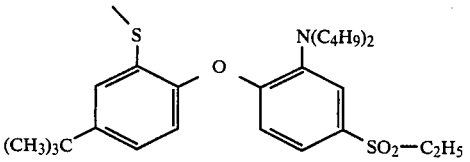
A15
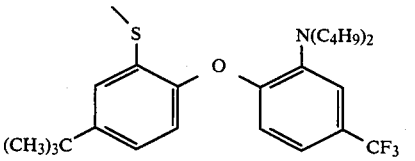
The following are examples of basic structures of coupler:

B1
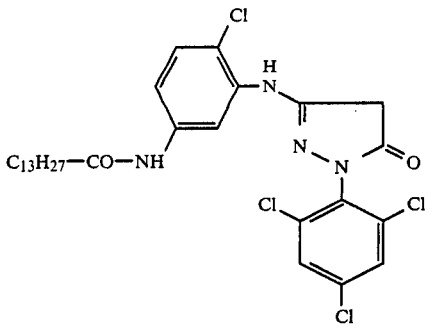
B2
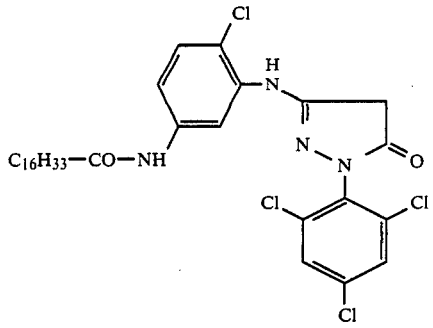
B3
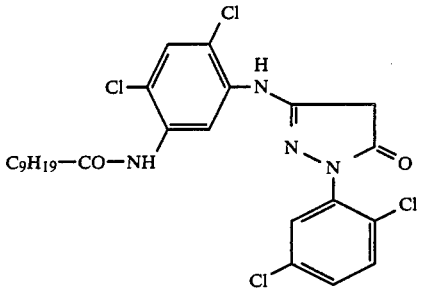
B4
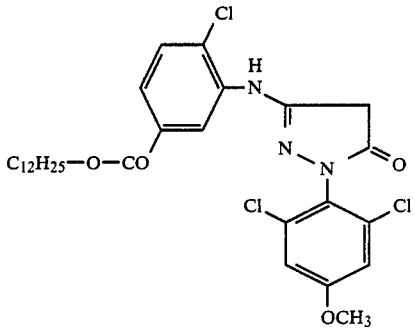
B5
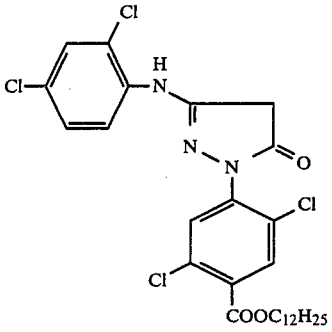
B6
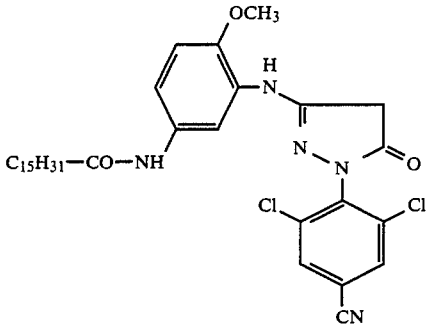
B7
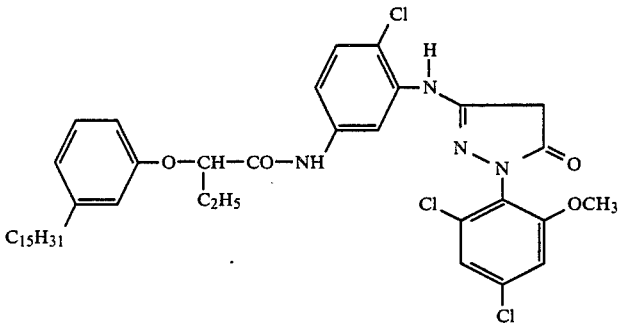
B8
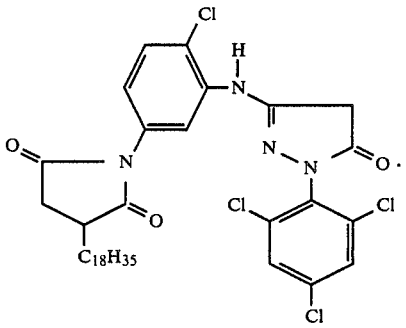

The following are examples of basic structures of couplers:

The compounds entered in the following Table are particularly preferred couplers.

| No. | Basic Structure of coupler | Fugitive group |
|---|---|---|
| 1 | B1 | A1 |
| 2 | B1 | A2 |
| 3 | B1 | A3 |
| 4 | B1 | A4 |
| 5 | B1 | A6 |
| 6 | B1 | A7 |
| 7 | B1 | A9 |
| 8 | B1 | A10 |
| 9 | B1 | A11 |
| 10 | B1 | A13 |
| 11 | B2 | A2 |
| 12 | B2 | A5 |
| 13 | B2 | A10 |
| 14 | B3 | A2 |
| 15 | B3 | A15 |
| 16 | B4 | A2 |
| 17 | B4 | A7 |
| 18 | B4 | A8 |
| 19 | B5 | A1 |
| 20 | B5 | A11 |
| 21 | B6 | A4 |
| 22 | B7 | A2 |
| 23 | B7 | A6 |
| 24 | B7 | A9 |
| 25 | B7 | A10 |
| 26 | B7 | A15 |
| 27 | B8 | A1 |
| 28 | B8 | A3 |
| 29 | B8 | A7 |
| 30 | B8 | A12 |

The couplers according to the invention are prepared from the corresponding pyrazolone derivatives having a free 4-position (4-equivalent couplers) and a thiophenol derivative corresponding to the fugitive group. The following methods may be employed:

1. A thiophenol derivative or the corresponding disulphide is converted into a sulphenyl halide by reaction with a halogenating agent (for example, chlorine, bromine, sulphuryl chloride, N-bromosuccinimide, etc.) and then reacted with a 4-equivalent coupler in the presence of a catalyst. This method may also be carried out by the addition of a halogen (i.e. halogen in the form of a gas or liquid) to a mixture of a thiophenol derivative and a 4-equivalent coupler (U.S. Pat. No. 3,227,554).
2. After the amino group of a 4-equivalent coupler has been protected by acylation (for example insertion of an acetyl group or of an ethoxycarbonyl group), the active position of the coupler is treated with a halogenating agent and the resulting compound is reacted with a thiophenol derivative in the presence of a basic catalyst or without catalyst. The desired 2-equivalent coupler is obtained by removal of the protective group (JA-OS No. 91862/77).

The method of preparation of the thiophenol derivatives is illustrated by the following examples of synthesis. The method of preparing the basic structures of the couplers is known.

SYNTHESIS OF COUPLER 2

1st Stage 106 g of 4-tert.-octylphenol and 148 g of p-fluoronitrobenzene are dissolved in dimethylacetamide, and 80 g of sodium hydroxide dissolved in 100 g of water are added at 30° to 40° C. When the reaction has died down, the reaction mixture is stirred into ice/hydrochloric acid and suction filtered. The product is then washed, dried and recrystallized from acetonitrile.

Yield: 236 g (72%) of 4-nitro-4'-octyl-diphenylether. melting point: 69°–71° C.

2nd Stage 118 g of the compound obtained in the 1st Stage are dissolved in 600 ml of methylene chloride and 126 g of chlorosulphonic acid are then added at a low temperature. The reaction mixture is slowly heated to room temperature and stirred out on ice. The organic phase is washed, dried and concentrated by evaporation. The product is recrystallised from ligroin.

Yield: 138 g (94%) of 4-nitro-4'-octyldiphenylether-2'-sulphonic acid.

m.pt. 123°–125° C.

3rd Stage 139 g of the compound obtained in the 2nd Stage are hydrogenated in 600 ml of methanol at 40° to 50° C. and a hydrogen pressure of 20 bar, using Raney nickel as catalyst. The hydrogenation product is dissolved in sodium hydroxide solution and suction filtered to remove Raney nickel and the solution is acidified with hydrochloric acid. The colourless precipitate obtained is suction filtered, washed with water and dried.

Yield: 108 g (85%) of 4-amino-4'-octyl-diphenylether-2'-sulphonic acid.

m.pt. >330° C.

4th Stage 108 g of the compound obtained in the 3rd Stage are dissolved in dimethylformamide with 240 ml of triethylamine, and 127 g of n-bromobutane are then added at 80° C. The resulting reaction mixture is heated to the reflux temperature and 64 g of n-bromobutane are added dropwise. The reaction mixture is boiled for 3 hours and then stirred out on ice/hydrochloric acid. The precipitate obtained is suction filtered and dried and the product is recrystallized from acetone.

Yield: 122 g (87%) of 4-dibutylamino-4'-octyl-diphenylether-2'-sulphonic acid, m.pt. 326°–328° C.

5th Stage 122 g of the compound obtained in the 4th Stage are heated to 80° C. and 73 g of phosphorus pentachloride are added portionwise. The reaction mixture is then stirred at 100°–120° C. and poured out on ice water. The product is taken up with methylene chloride, washed with water, dried and concentrated by evaporation. A viscous oil is obtained. This is used in the 6th Stage without further purification.

6th Stage (Fugitive group A2)

The oil obtained in the 5th Stage is dissolved in a small quantity of tetrahydrofuran, and a mixture of 160 ml of water, 50 ml of sulphuric acid and 160 ml of hydrochloric acid is added to the solution. 60 g of zinc powder are added portionwise at 50° C. The reaction mixture is then stirred under reflux for 3 hours, taken up with ethyl acetate, washed and dried. A viscous oil is obtained after removal of the solvent by evaporation.

Yield: 85 g (80%).

7th Stage 85 g of the thiophenol compound obtained in the 6th Stage are dissolved in 350 ml of methylene chloride. 29 g of sulphuryl chloride are added to the solution at 20° C. The solution is then concentrated down to 200 ml by evaporation and added to a suspension of 53 g of the sodium salt of toluene sulphonic acid in 600 ml of methylene chloride. The reaction mixture is stirred at room temperature and then diluted with water. The reaction mixture is washed, dried and concentrated by evaporation. The residue is recrystallized from ethanol.

Yield: 81 g (75%), melting point 67°-68° C.

8th Stage Coupler 2

41 g of 4-equivalent coupler B1 and 57 g of the compound obtained in the 7th Stage are dissolved in 500 ml of ethanol. A solution of 5.5 g of sodium methylate in 16 ml of methanol is then slowly added at 30° C. The reaction mixture is stirred and poured out on ice/hydrochloric acid. The organic phase is taken up in ethyl acetate and washed with sodium bicarbonate and water. The solution in ethyl acetate is dehydrated with sodium sulphate and concentrated by evaporation. The residue is redissolved from cleaning petrol and then recrystallized from acetonitrile.

Yield: 52 g (74%) of Compound 2, melting point 114°-117° C.

SYNTHESIS OF COUPLER 1

1st Stage

The method is the same as the 1st Stage for Coupler 2 but instead of tert.-octylphenol, the equimolar quantity of tert.-butylphenol is used.

2nd Stage 99 g of the compound obtained in the 1st Stage are dissolved in ethyl acetate and hydrogenated with hydrogen at a pressure of 15 to 20 bar and at 50°-60° C., using Raney nickel as catalyst. The Raney nickel is then removed by suction filtration and the filtrate is concentrated by evaporation.

Yield: 84 g (97%) of 4-amino-4'-tert.-butyl-diphenylether.

3rd Stage 84 g of the compound obtained in the 2nd Stage are dissolved in 700 ml of dimethylformamide with 280 g of tributylamine. 192 g of n-bromobutane are then slowly added at the reflux temperature. The reaction mixture is stirred for a further 3 hours and then poured out on ice/hydrochloric acid. The residue is taken up in ethyl acetate, washed, dried and concentrated by evaporation. 101 g (82%) of an oily compound are obtained.

4th Stage 101 g of the compound obtained in Stage 3 are dissolved in 600 ml of methylene chloride. 101 g of chlorosulphonic acid are added dropwise at −10° C. The temperature of the reaction mixture is raised slowly to 0° C. and then to 20° C. and the reaction mixture is stirred, filtered and concentrated by evaporation. The residue obtained is redissolved from methyl ethyl ketone. 105 g (84%) of the desired sulphonic acid melting at 314°-317° C. are obtained.

5th Stage (Fugitive group A1)

105 g of the compound obtained in Stage 4 are heated to 60° C. and 70 g of phosphorus pentachloride are added portionwise, causing a rise in temperature. The mixture is then stirred at 100° C. and a mixture of 120 ml of water, 40 ml of concentrated sulphuric acid and 120 ml of concentrated hydrochloric acid is carefully added to the cooled residue. 60 g of zinc powder are carefully added portionwise to this mixture at 40°-50° C. The mixture is then stirred at 100° C. until reduction is complete. The residue is then taken up in ethyl acetate and washed with sodium bicarbonate and then with water. The residue is dried and concentrated by evaporation. 81.5 g (88%) of an oily compound is obtained. This is used for the next stage without further purification.

6th Stage 81.5 g of the oil obtained in Stage 5 are dissolved in 350 ml of methylene chloride. 30 g of sulphuryl chloride are slowly added dropwise at room temperature. The solution is then stirred for one hour and slowly added dropwise at 25°-30° C. to a suspension of 53 g of sodium p-toluene sulphonate in 500 ml of methylene chloride. The reaction mixture is then stirred for 3 hours at room temperature, poured out on water and separated. The product is washed, first with a 5% by weight bicarbonate solution and then with a 1:3 mixture of methanol:water. It is then dehydrated, filtered and concentrated by evaporation.

The product is recrystallized from petroleum ether.

Yield: 89.5 g (83%).

melting point: 76°-78° C.

7th Stage

Same as Stage 8 for the synthesis of Coupler 2 but using 77 g of Coupler B1 and 89.5 g of the compound obtained in Stage 6. The product is redissolved from methanol.

Yield: 86 g (69) of Compound 1.

melting point: 102°-105° C.

For the preparation of the lilght-sensitive colour photographic recording material, the diffusion resistant couplers of the present invention may be incorporated in known manner in the casting solution of the silver halide emulsion layers or other colloid layers. Oil-soluble or hydrophobic couplers, for example, may advantageously be added to a hydrophilic colloid solution from a solution in a suitable coupler solvent (oil former), optionally in the presence of a wetting agent or dispersing agent. The hydrophilic casting solution may, of course, contain other conventional additives in addition to the binder. The solution of coupler need not be directly dispersed in the casting solution for the silver halide emulsion layer or other water-permeable layer but may advantageously first be dispersed in an aqueous solution of hydrophilic colloid which is not sensitive to light, and the resulting mixture may then be mixed with the casting solution for the light-sensitive silver halide emulsion layer or some other water-permeable layer, optionally after removal of the low boiling organic solvent, and the resulting mixture may then be used for casting.

The light-sensitive silver halide emulsions used may be emulsions of silver chloride, silver bromide or mixtures thereof, optionally with a silver iodide content of up to 10 mol-%, in one of the usual hydrophilic binders. The binder used for photographic layers is preferably gelatine although this may be partly or completely replaced by other natural or synthetic binders.

The emulsions may be chemically and spectrally sensitized in the usual manner and both the emulsion layers and other, light-insensitive layers may be hardened in the usual manner with known hardeners.

Colour photographic recording materials normally contain at least one silver halide emulsion layer for each of the three spectral regions, red, green and blue. The light-sensitive layers are spectrally sensitized for this purpose in known manner by means of suitable sensitizing dyes although the blue-sensitive silver halide emulsion layers need not necessarily contain a spectral sensitizer since the intrinsic sensitivity of the silver halide is in many cases sufficient for recording blue light.

Each of the above-mentioned light-sensitive layers may consist of a single layer or it may comprise two or more silver halide emulsion partial layers, e.g. as in the so-called double layer arrangement (DE-C No. 1 121 470). Red-sensitive silver halide emulsion layers are normally arranged closer to the layer support than the green-sensitive silver halide emulsion layers and these in turn are arranged closer to the support than the blue-sensitive layers and are generally separated from the blue-sensitive layers by a light-insensitive yellow filter layer. Other arrangements could also be used. Layers differing in their spectral sensitivity are generally separated by a light-insensitive interlayer which may contain agents for preventing accidental diffusion of developer oxidation products. If a photographic material contains several silver halide emulsion layers of the same spectral sensitivity, these layers may be adjacent to one another or they may be separated by a light-sensitive layer with a different spectral sensitivity (DE-A-No. 1 958 709, DE-A-No. 2 530 645, DE-A-No. 2 622 922).

Colour photographic recording materials for the production of multicolour images normally contain different colour producing compounds in spatial and spectral association with the various silver halide emulsion layers of the different spectral sensitivities to produce the different partial colour images in cyan, magenta and yellow, these colour producing compounds being in the present case in particular colour couplers.

By "spatial association" is meant that the colour coupler is in such a spatial relationship to the silver halide emulsion layer that the two are capable of interacting to give rise to an imagewise correspondence between the silver image resulting from development and the colour image produced from the colour coupler. This is generally achieved by incorporating the colour coupler in the silver halide emulsion layer or in an adjacent layer of binder which may be insensitive to light.

By "spectral association" is meant that the spectral sensitivity of each of the light-sensitive silver halide emulsion layers and the colour of the partial colour image produced from the colour coupler which is spatially associated with the particular silver halide emulsion layer are related to one another in a particular manner, each spectral sensitivity (red, green, blue) being associated with a different colour of the particular partial colour image (e.g. cyan, magenta, yellow).

Each of the silver halide emulsion layers which differ in their spectral sensitivity may have one or more colour couplers associated therewith. If several silver halide emulsion layers have the same spectral sensitivity, then each of these layers may contain a colour coupler which need not be identical to the couplers of the other layers of the same spectral sensitivity, provided only that they all give rise to at least approximately the same colour on colour development, normally a colour which is complementary to the colour of the light to which these silver halide emulsion layers are predominantly sensitive.

In preferred embodiments, therefore, red-sensitive silver halide emulsion layers are associated with at least one non-diffusible colour coupler for producing the cyan partial colour image, generally a coupler of the phenol or $\alpha$-naphthol series; green-sensitive silver halide emulsion layers are associated with at least one non-diffusible colour coupler for producing the magenta partial colour image, normally a coupler of the 5-pyrazolone, the indazolone or the pyrazolo-triazole series, and blue-sensitive silver halide emulsion layers are associated with at least one non-diffusible colour coupler for producing the yellow partial colour image, generally a colour coupler containing an open chain keto methylene group. Many colour couplers of this kind are known and have been described in numerous Patent Specifications and other publications, for example in the publication entitled "Farbkuppler" by W. PELZ in "Mitteilungen aus den Forschungslaboratorien der Agfa, Leverkusen/München", Volume III, page 111 (1961) and the publication by K. VENKATARAMAN in "The Chemistry of Synthetic Dyes", Vol. 4, 341 to 387, Academic Press (1971).

The colour couplers may be conventional 4-equivalent couplers or they may be 2-equivalent couplers which require a smaller quantity of silver halide for producing the colour. 2-Equivalent couplers are derived, as is known, from 4-equivalent couplers in that they carry in the coupling position a substituent which is split off in the coupling reaction. 2-Equivalent couplers include both those which are virtually colourless and those which have an intense colour of their own which disappears in the process of colour coupling to be replaced by the colour of the image dye produced. The last-mentioned type of coupler may be present additionally in the light-sensitive silver halide emulsions layers to act as masking couplers to compensate for unwanted side densities of the image dyes. The 2-equivalent couplers also include the known white couplers which do not give rise to a dye in their reaction with colour developer oxidation products. Further, the 2-equivalent couplers include the known DIR couplers which carry in the coupling position a group which is released as diffusible development inhibitor when the coupler reacts with coupler developer oxidation products. Such couplers may also release other, photographically active compounds in the process of development, e.g. development accelerators or fogging agents.

According to this invention, the colour photographic recording material contains at least one 2-equivalent magenta coupler corresponding to formula I.

In addition to the components already mentioned, the colour photographic recording material according to the present invention may contain additives such as, for example, antioxidants, dye stabilizers and agents for influencing the mechanical and electrostatic properties. It is advantageous to incorporate UV absorbent compounds in one or more layers of the recording material, preferably in one of the upper layers, for the purpose of preventing or reducing the deleterious effect of UV light on the colour images produced with the colour photographic recording material according to the invention. Suitable UV absorbents have been described, for example, in US-A-No. 3 253 921, DE-C-No. 2 036 719 and EP-A-No. 0 057 160.

The colour photographic images are produced by developing the colour photographic recording material according to the invention with a colour developer compound. Any developer compounds which in the form of their oxidation product are capable of reacting with colour couplers to produce azomethine dyes may be used as colour developer compounds. Aromatic compounds of the p-phenylenediamine series containing at least one primary amino group are suitable colour developer compounds, e.g. N,N-dialkyl-p-phenylenediamines such as N,N-diethyl-p-phenylenediamine, 1-(N-ethyl-N-methyl-sulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

The usual layer supports may be used for the materials according to the invention; see Research Dislosure No. 17 643, Section XVII.

The usual hydrophilic film-forming agents may be used as protective colloids or binders for the layers of the photographic material, e.g. proteins, in particular gelatine. Casting auxiliaries and softeners may also be used. See the compounds indicated in the above-mentioned Research Disclosure 17 643, Sections IX, XI and XII.

The layers of the photographic material may be hardened in the usual manner, for example with hardeners of the type of epoxides, heterocyclic ethyleneimines and acryloyls. Hardening of the layers may also be carried out by the process according to German Offenlegungsschrift No. 2 218 009 to produce colour photographic materials suitable for high temperature processing. The photographic layes may also be hardened with compounds of the diazine, triazine or 1,2-dihydroquinoline series or with vinyl sulphone type hardeners. Other suitable hardeners are disclosed in German Offenlegungsschriften Nos. 2 439 551, 2 225 230 and 2 317 672 and in the above mentioned Research Disclosure 17 643, Section XI.

Other suitable additives are mentioned in Research Disclosure 17 643 and in "Product Licensing Index" of December 1971, pages 107–110.

Other suitable colour developers have been described, for example, in J. Amer. Chem. Soc. 73, 3100 (1951) and by G. Haist in Modern Photographic Processing, 1979, John Wiley and Sons, New York, pages 545 et seq.

The material is normally bleached and fixed after colour development. Bleaching and fixing may be carried out separately or together. The usual bleaching agents may be used, e.g. $Fe^{3+}$ salts or $Fe^{3+}$ complex salts such as ferricyanides, dichromates, water-soluble cobalt complexes, etc. Iron-III complexes of aminopolycarboxylic acids are particularly preferred, e.g. ethylene diaminotetracetic acid, N-hydroxyethylethylene diaminotriacetic acid, alkyliminodicarboxylic acids and the corresponding phosphonic acids. Persulphates are also suitable bleaching agents.

Comparison couplers used in Example 1:

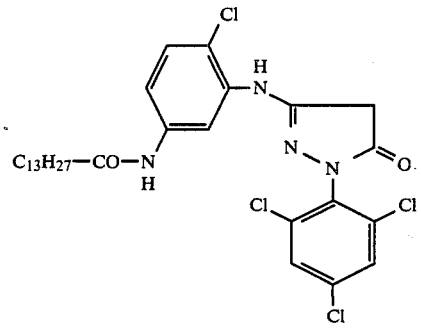

(1)

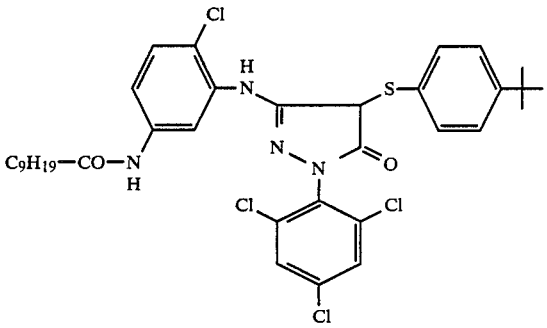

(2)

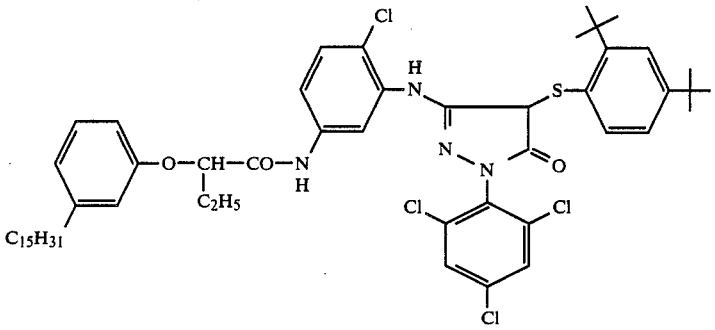

(3)

-continued

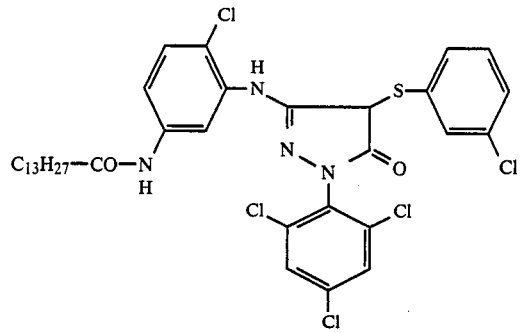

(4)

EXAMPLE 1

10 g of Comparison coupler 1 are dissolved in 10 ml of dibutylphthalate and 30 ml of ethyl acetate. The solution is dispersed in 100 g of a 7.5% aqueous gelatine solution, using sodium dodecylbenzene sulphonate as wetting agent. The emulsion obtained is mixed in such proportions with 7.5% by weight gelatine solution containing fine silver bromide particles dispersed therein that the resulting mixture contains 7.5 g of $AgNO_3$ to 8 mmol of coupler. This mixture is diluted with water and a further quantity of wetting agent. The casting solution is cast on a transparent cellulose triacetate support in an amount corresponding to about 1.1 mmol of coupler per $m^2$ of the layer (Sample A). Sample B shown in Table 1 is prepared by a simialr method but with the magenta coupler mentioned there instead of Comparison coupler 1. When 2-equivalent couplers are used, only 4 g of $AgNO_3$ are used in the mixture described above. The samples were cut into strips which were exposed behind a grey step wedge and developed in the developer described below.

| | |
|---|---|
| Developer Solution: | |
| Benzyl alcohol | 12 g |
| Hydroxylamine sulphate | 3 g |
| Sodium hydroxide | 1 g |
| Potassium bromide | 0.7 g |
| 4-Amino-3-methyl-N—ethyl-N—β-(methane-sulphonamido)-ethylaniline | 5 g |
| Potassium carbonate | 33 g |
| made up with water to | 1000 ml |
| | pH 10.2 |
| Bleach fixing bath | |
| $NH_4FeEDTA$ | 45 g |
| Ethylenediaminotetracetic acid | 2.5 g |
| Ammonium thiosulphate | 90 g |
| Sodium sulphite | 5 g |
| made up with water to | 1000 ml: |
| | pH 6.6 |
| Processing stage (at 33° C.) | |
| Development | 3.5 min |
| Bleach fixing | 1.5 min |
| Washing | 3 min |

The samples prepared and processed as described above were tested for their light fastness and heat resistance.

The light fastness was determined by exposing the samples in a Xeno test apparatus (40% R.H; 25° C.; $5\times10^6$ Lux hours). The percentage reduction in density measured behind a green filter, taking the original density as 1.0, is entered in Table 3.

To determine the heat resistance, other samples were stored at 60° C. and 90% relative humidity for one week (Table 3). Table 3 also shows the increase in yellow density of the samples stored under these conditions.

Table 2 shows the sensitivities, maximum densities and magenta discolourations in the unexposed areas of the samples after processing. Measurement of density behind green filter:

$D_A$=density of sample investigated $D_B$=density of support

Determination $D_{min}=D_A-D_B$.

TABLE 1

| Sample | |
|---|---|
| A | Comparison coupler 1 |
| B | Comparison coupler 2 |
| C | Comparison coupler 3 |
| D | Comparison coupler 4 |
| E | Coupler 1 according to the invention |
| F | Coupler 2 according to the invention |
| G | Coupler 10 according to the invention |
| H | Coupler 15 according to the invention |
| J | Coupler 24 according to the invention |
| K | Coupler 28 according to the invention |

TABLE 2

| Sample | Sensitivity [DIN] | $D_{max}$ | $D_{min}$ |
|---|---|---|---|
| A | 22.3 | 2.3 | +0.01 |
| B | 24.2 | 3.0 | +0.17 |
| C | 24.4 | 3.1 | +0.14 |
| D | 24.5 | 2.9 | +0.16 |
| E | 24.9 | 3.2 | +0.02 |
| F | 24.7 | 3.3 | +0.01 |
| G | 24.1 | 3.1 | +0.03 |
| H | 24.5 | 3.1 | +0.04 |
| J | 24.3 | 3.0 | +0.04 |
| K | 24.7 | 3.2 | +0.03 |

Table 2 shows that the couplers according to the invention react with a high colour formation kinetics and that these couplers have a high colour formation tendency and thus behave as true 2-equivalent couplers. At the same time, the magenta discolouration of unexposed areas normally found in 2-equivalent couplers is minimized. In this respect, the compounds according to the invention are equal to the 4-equivalent couplers (Sample A).

TABLE 3

| Sample | Light Fastness [%] | Heat Resistance Change of density in front of white background | |
|---|---|---|---|
| | | Yellow | Magenta |
| A | −46 | +0.25 | +0.08 |
| B | −55 | +0.07 | +0.12 |
| C | −47 | +0.04 | +0.14 |
| D | −27 | +0.02 | +0.14 |

TABLE 3-continued

| Sample | Light Fastness [%] | Heat Resistance Change of density in front of white background Yellow | Magenta |
|---|---|---|---|
| E | −16 | +0.03 | +0.05 |
| F | −12 | +0.02 | +0.06 |
| G | −17 | +0.04 | +0.04 |
| H | −18 | +0.05 | +0.05 |
| J | −15 | +0.03 | +0.07 |
| K | −16 | +0.02 | +0.04 |

Table 3 shows the high light fastness of the dyes produced from the couplers according to the invention. It also shows that the compounds respond favourably to storage under tropical conditions. Yellowing of the kind occurring in 4-equivalent couplers is virtually absent and the magenta density increase under moist storage conditions is distinctly less than found in prior art 2-equivalent couplers.

Comparison couplers used in Example 2 below.

COMPARISON 5

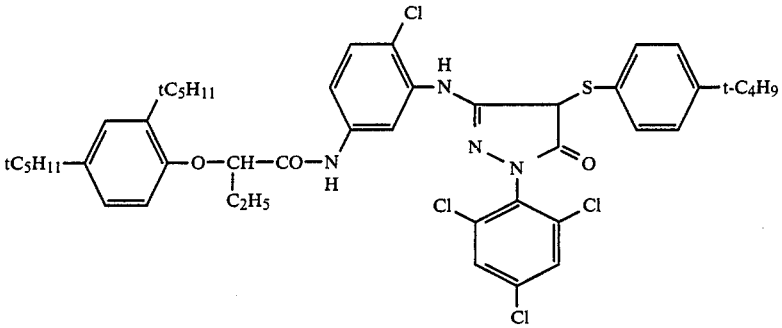

COMPARISON 6

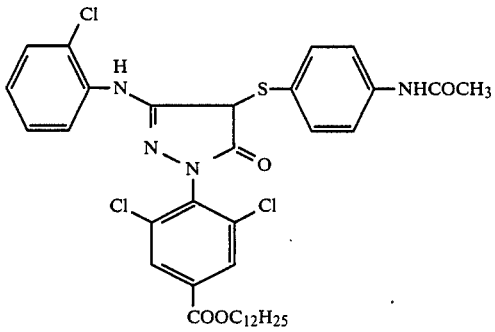

EXAMPLE 2

Casting solutions were prepared as in Example 1. The mixtures were applied as a layer to a paper support which had been laminated on the surface with polyethylene. The resulting samples were exposed behind a grey step wedge and developed by the same method as in Example 1 except that the bleach fixing times were 0.75, 1.5 and 3.0 minutes.

TABLE 4

| Sample | | Side densities | $D_B$ | + | $D_5$ |
|---|---|---|---|---|---|
| | Coupler | 0.75 | 1.5 | | 3.0 |
| L | Comparison 1 | 0.24 | 0.01 | | 0.00 |
| M | Comparison 5 | 0.81 | 0.37 | | 0.05 |

TABLE 4-continued

| Sample | | Side densities | $D_B$ | + | $D_5$ |
|---|---|---|---|---|---|
| N | Comparison 6 | 0.92 | 0.46 | | 0.12 |
| O | according to the invention | | | | |
| | Coupler 1 | 0.31 | 0.02 | | 0.01 |
| P | Coupler 2 | 0.21 | −0.01 | | 0.00 |
| Q | Coupler 19 | 0.18 | 0.01 | | 0.01 |
| R | Coupler 26 | 0.24 | 0.02 | | 0.01 |

$D_B+D_R$ were determined by reflection measurements, setting the value for the longest bleached sample L arbitrarily at zero and subtracting this measured value from that of the other samples at the same main colour density. The main colour density observed was in all samples D=2.0.

The Table shows that the couplers according to the invention do not inhibit bleaching of the silver and therefore cause no residual silver image to be left in the developed material. In this respect the 2-equivalent couplers according to the invention behave like 4-equivalent couplers (Sample L). Samples M and N show that a slight residual silver image is left even when the bleaching time is twice as long.

EXAMPLE 3

Samples L-R obtained in Example 2 were subjected to the development process described in Example 1 and to a modified development process in which the composition used for development differed from that described above in that it contained no benzyl alcohol.

TABLE 5

| Sample | Development + Benzyl alcohol Sensitivity | Density | − Benzyl alcohol Sensitivity | Density |
|---|---|---|---|---|
| L | 23.4 | 2.3 | 23.2 | 2.2 |
| M | 23.9 | 3.4 | 21.8 | 3.1 |
| N | 21.8 | 2.6 | 20.2 | 2.3 |
| O | 24.1 | 3.2 | 24.4 | 3.2 |
| P | 24.3 | 3.3 | 23.9 | 3.2 |
| Q | 23.9 | 3.1 | 24.2 | 3.2 |
| R | 24.0 | 3.1 | 23.8 | 3.1 |

The Table shows that the couplers according to the invention can be developed with comparable results in developers with and without benzyl alcohol.

EXAMPLE 4

A layer support of paper coated with polyethylene on both sides was covered with the following layers. The quantities are based on 1 $m^2$.

1. A substrate layer containing 200 mg of gelatine with the addition of $KNO_3$ and chromealum 2. A blue-sensitive silver chlorobromide emulsion layer (5 mol-% chloride) containing 600 mg of $AgNO_3$ with 2100 mg of gelatine, 1.1 mmol of yellow coupler Y, 27.7 mg of 2,5-dioctyl hydroquinone and 1200 mg of tricresyl phosphate
3. An interlayer of 1300 mg of gelatine with 80 mg of 2,5-dioctyl hydroquinone and 100 mg of tricresyl phosphate
4. A green-sensitive silver chlorobromide emulsion layer (20 mol-% chloride) of 330 mg of $AgNO_3$ with 750 mg of gelatine, 0.500 mmol of magenta coupler, 118 mg of α-(3-t-butyl-4-hydroxyphenoxy)-myristic acid ethyl ester, 43 mg of 2,5-dichlorooctyl hydroquinone, 343 mg of dibutyl phthalate and 43 mg of tricresylphosphate
5. An interlayer of 1550 mg of gelatine, 285 mg of UV absorbent corresponding to the formula

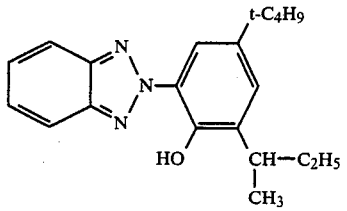

80 mg of dioctyl hydroquinone and 650 mg of tricresyl phosphate
6. A red-sensitive silver chlorobromide emulsion layer (20 mol-% chloride) of 400 mg of $AgNO_3$ with 1470 mg of gelatine, 0.780 mmol of cyan coupler C, 285 mg of dibutylphthalate and 122 mg of tricresylphosphate
7. A protective layer of 1200 mg of gelatine and 134 mg of the UV absorbent used in layer 5
8. A hardening layer of 400 mg of gelatine with 400 mg of hardener corresponding to the formula

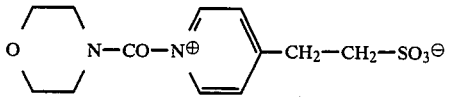

Various photographic materials were prepared with the magenta couplers shown in the following Table.

After the samples had been exposed and processed as described in Example 1, they were subjected to a fading test in which they were exposed to a total quantity of light of $9.6 \cdot 10^6$ Lux·h.

TABLE

| Complete layer combination | Magenta Coupler | Xenon test: Magenta density originally D = 1.0 | Xenon test: Yellow density increase (image whites) |
|---|---|---|---|
| 1 | Comparison 1 | 0.78 | +0.122 |

TABLE-continued

| Complete layer combination | Magenta Coupler | Xenon test: Magenta density originally D = 1.0 | Xenon test: Yellow density increase (image whites) |
|---|---|---|---|
| 2 | Comparison 2 | 0.42 | +0.076 |
| 3 | Comparison 3 | 0.48 | +0.085 |
| 4 | according to the invention 2 | 0.84 | +0.048 |
| 5 | according to the invention 15 | 0.87 | +0.057 |
| 6 | according to the invention 19 | 0.85 | +0.042 |
| 7 | according to the invention 29 | 0.90 | +0.054 |

The Table shows that the magenta couplers according to the invention maintain their advantageous properties in multilayered materials. These properties are in particular the approved light fastness both of the dye formed from the couplers and of the 2-equivalent couplers themselves.

Yellow coupler Y

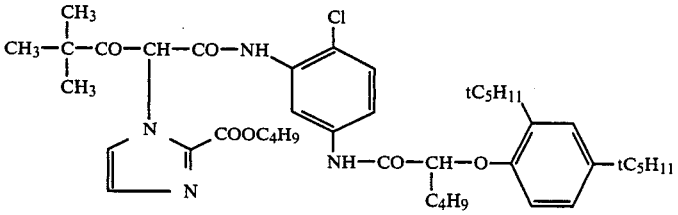

Cyan coupler C

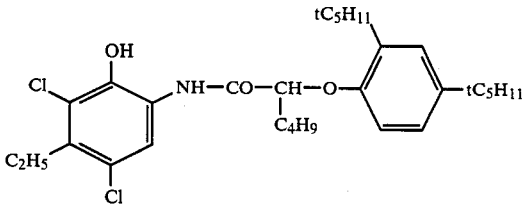

What is claimed is:

1. Colour photographic recording material containing at least one silver halide emulsion layer and at least one layer containing a 2-equivalent magenta coupler corresponding to the formula

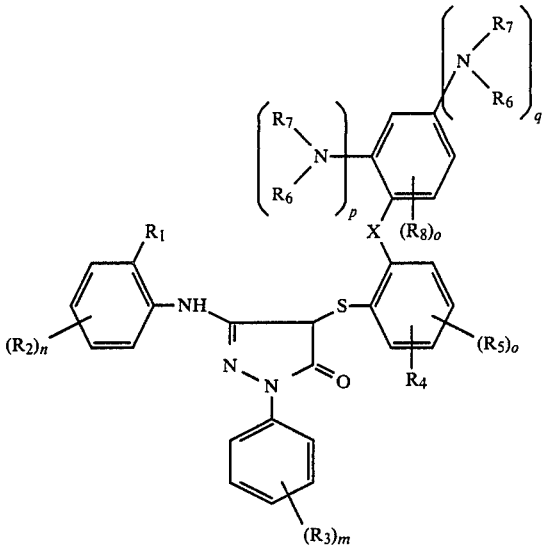

wherein

X denotes O, S or $NR_9$, $R_1$ denotes hydrogen, halogen or alkoxy, $R_2$ denotes halogen, alkoxy, acylamino, alkoxycarbonyl, aminocarbonyl which may be substituted on the nitrogen or aminosulphonyl which may be substituted on the nitrogen, $R_3$ denotes hydrogen, halogen, cyano, alkoxy, alkyl, acylamino, alkoxycarbonyl or alkylsulphonyl, $R_4$ denotes hydrogen or alkyl, $R_5$ denotes a substituent having electron donor properties, $R_6$ and $R_7$ denote alkyl, acyl or alkylsulphonyl, $R_8$ denotes a substituent having electron acceptor properties, $R_9$ denotes hydrogen or alkyl, m represents a number from 1 to 5, n and o have the value 0, 1 or 2 and p and q have the value 0 or 1 and when m, n and/or o has a value >1, the respective substituents $R_2$, $R_3$, $R_5$ and $R_8$ may be identical or different, and the sum of p and q is 1 or 2.

2. Colour photographic recording material according to claim 1, characterised in that X denotes O, $R_1$ denotes hydrogen, chlorine or $C_1$ to $C_4$-alkoxy, $R_2$ denotes chlorine, $C_8$ to $C_{20}$-alkylcarbonylamino or $C_{10}$ to $C_{18}$-alkoxycarbonyl, $R_3$ denotes chlorine, cyano, $C_1$–$C_4$-alkoxy or $C_{10}$ to $C_{18}$-alkoxycarbonyl, $R_4$ denotes hydrogen or tert.-$C_4$–$C_8$-alkyl, $R_5$ denotes hydroxyl, chlorine or $C_1$ to $C_6$-alkyl, $R_6$ and $R_7$ denote $C_1$ to $C_4$-alkyl, $R_8$ denotes chlorine, cyano or trifluoromethyl, m=1 to 3, n, o, p and q=0 or 1 and the sum of p+q=1 or 2.

3. Colour photographic recording material according to claim 1, characterised in that 2-equivalent magenta couplers corresponding to the formula

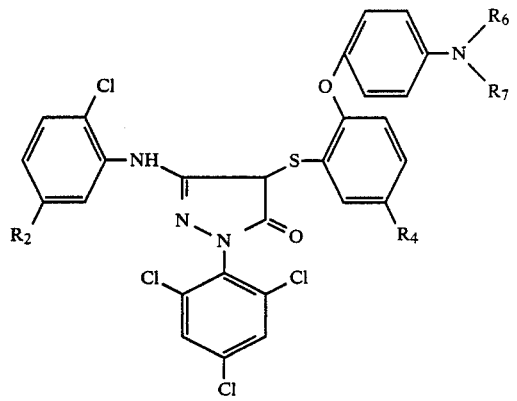

are used, in which formula $R_2$ denotes $C_8$- to $C_{20}$-alkylcarbonylamino, $R_4$ denotes tert.-$C_4$- to $C_8$-alkyl and $R_6$ and $R_7$ denote $C_1$- to $C_4$-alkyl.

* * * * *